US008978561B1

(12) United States Patent
Illston

(10) Patent No.: US 8,978,561 B1
(45) Date of Patent: Mar. 17, 2015

(54) MULTI BARREL PAINT BALL MINE POWERED BY FIREARM CARTRIDGE PRIMER

(76) Inventor: Keith Illston, Anaconda, MT (US)

( * ) Notice: Subject to any disclaimer, the term of this patent is extended or adjusted under 35 U.S.C. 154(b) by 0 days.

(21) Appl. No.: 13/413,772

(22) Filed: Mar. 7, 2012

Related U.S. Application Data

(60) Provisional application No. 61/475,305, filed on Apr. 14, 2011.

(51) Int. Cl.
*F42B 8/28* (2006.01)

(52) U.S. Cl.
CPC ..... *F42B 8/28* (2013.01)
USPC ..... 102/498

(58) Field of Classification Search
CPC ..... F42B 8/28; F42B 12/40
USPC ..... 102/407, 498, 502, 513
See application file for complete search history.

(56) References Cited

U.S. PATENT DOCUMENTS

| | | | | |
|---|---|---|---|---|
| 3,492,945 | A | 2/1970 | Filippi | |
| 4,944,521 | A | 7/1990 | Greeno | |
| 5,877,448 | A * | 3/1999 | Denton et al. | 102/401 |
| 5,996,503 | A * | 12/1999 | Woodall et al. | 102/498 |
| 6,289,819 | B1 * | 9/2001 | Dolderer | 102/513 |
| 6,688,234 | B2 | 2/2004 | Huber et al. | |
| 8,613,241 | B2 * | 12/2013 | Martinez et al. | 89/1.34 |

* cited by examiner

*Primary Examiner* — Stephen M Johnson
(74) *Attorney, Agent, or Firm* — Richard C. Conover

(57) ABSTRACT

A paint ball mine having an expansion chamber with a plurality of barrels mounted to a top wall of the expansion chamber. Each barrel opens into the expansion chamber and is adapted to receive a paint ball. A primer receptacle opens through one of the end walls of the expansion chamber adapted to receive a primer. A cocking rod having a firing pin is slidably movable from a cocked position to a firing position. A coil tension spring is mounted to the cocking rod for biasing the cocking rod toward the firing position. The cocking rod is movable against the bias force of the spring to the cocked position and apparatus is provided for releasably holding the cocking rod in the cocked position. A trigger device is used for releasing the cocking rod from the cocked position whereby the firing pin is advanced to the firing position.

8 Claims, 13 Drawing Sheets

MULTI BARREL PAINT BALL MINE POWERED BY FIREARM CARTRIDGE PRIMER

This application claims, the benefit of provisional application Ser. No. 61/475,305 filed Apr. 14, 2011.

BACKGROUND OF INVENTION

The present invention relates to a multi barrel paint ball mine powered by a firearm cartridge primer. The sport of paint ball allows individuals to participate in a simulated war game. Paint ball games utilize a number of paint ball weapons which utilize as ammunition small diameter paint balls filled with a dye to mark players that have been hit.

Among weapons used in the paint ball game, are devices to simulate a land mine. For example U.S. Pat. No. 5,877,448 to Denton et al. describes a reusable gas-powered war game land mine. U.S. Pat. No. 6,289,819 to Dolderer describes a single barrel paint ball land mine designed to simulate the function of a U.S. military claymore anti-personnel mine and U.S. Pat. No. 6,688,234 to Huber et al. describes a gas-powered paint ball land mine.

The present invention provides a paint ball land mine which is powered by a firearm cartridge primer. When the primer is discharged, paint balls are projected through multiple barrels outwardly with a resultant explosive noise which adds to the realism of this paint ball mine.

SUMMARY OF INVENTION

A paint ball mine having an expansion chamber with a plurality of barrels mounted to a top wall of the expansion chamber. Each barrel opens into the expansion chamber and is adapted to receive a paint ball. A primer receptacle opens through one of the end walls of the expansion chamber and is adapted to receive a firearm primer. A cocking rod is slidably mounted on the outer surface of the bottom wall and is movable from a cocked position to a firing position where a firing pin, secured to the cocking rod, strikes the primer. A coil tension spring is mounted to the cocking rod for biasing the cocking rod toward the firing position. The cocking rod is movable against the bias force of the spring to the cocked position and apparatus is provided for releasably holding the cocking rod in the cocked position. A trigger device is used for releasing the cocking rod from the cocked position whereby the cocking rod with firing pin are advanced to the firing position with the bias force of the spring.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
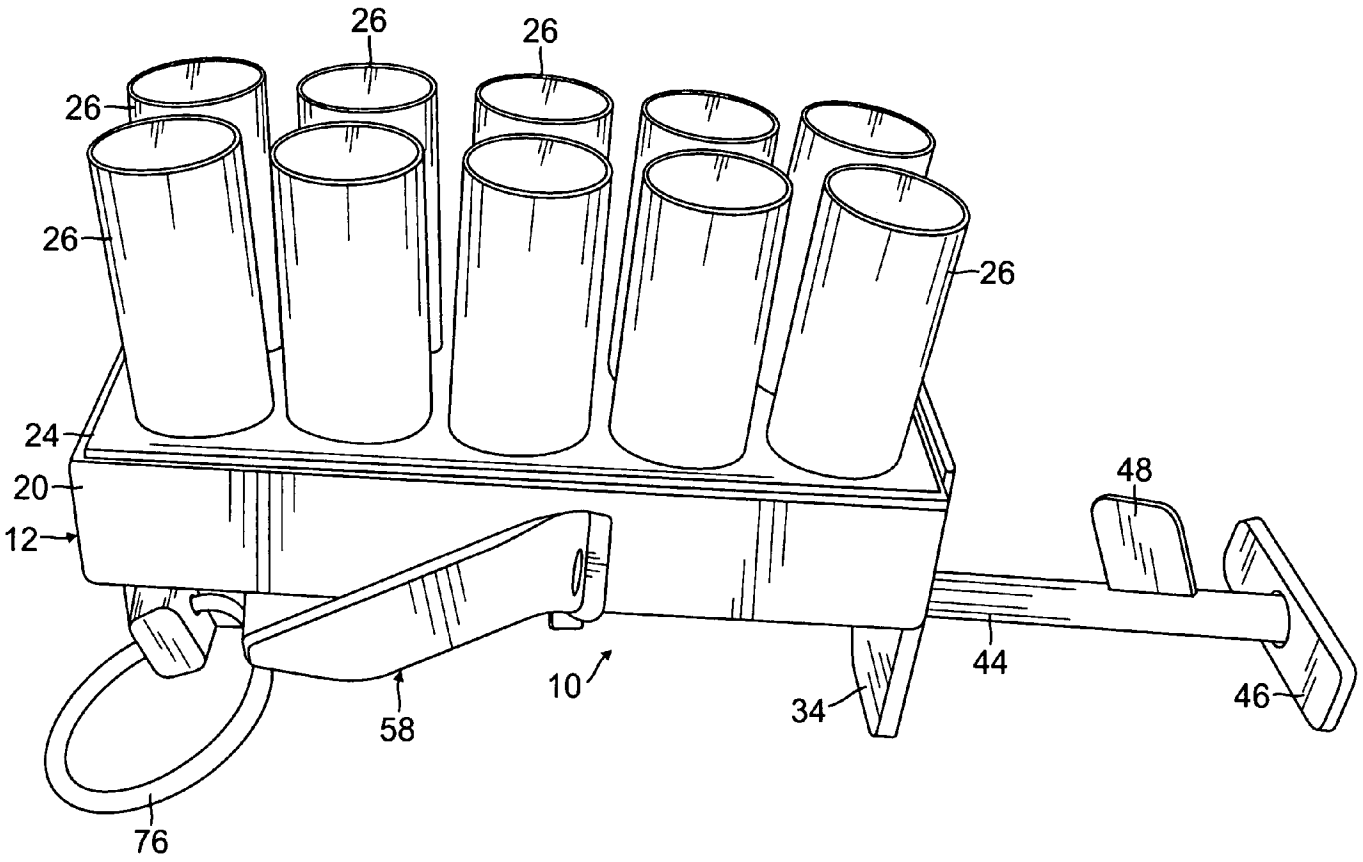
FIG. 1 is a perspective elevational view of a multi barrel paint ball mine according to the present invention.
Figure 2:
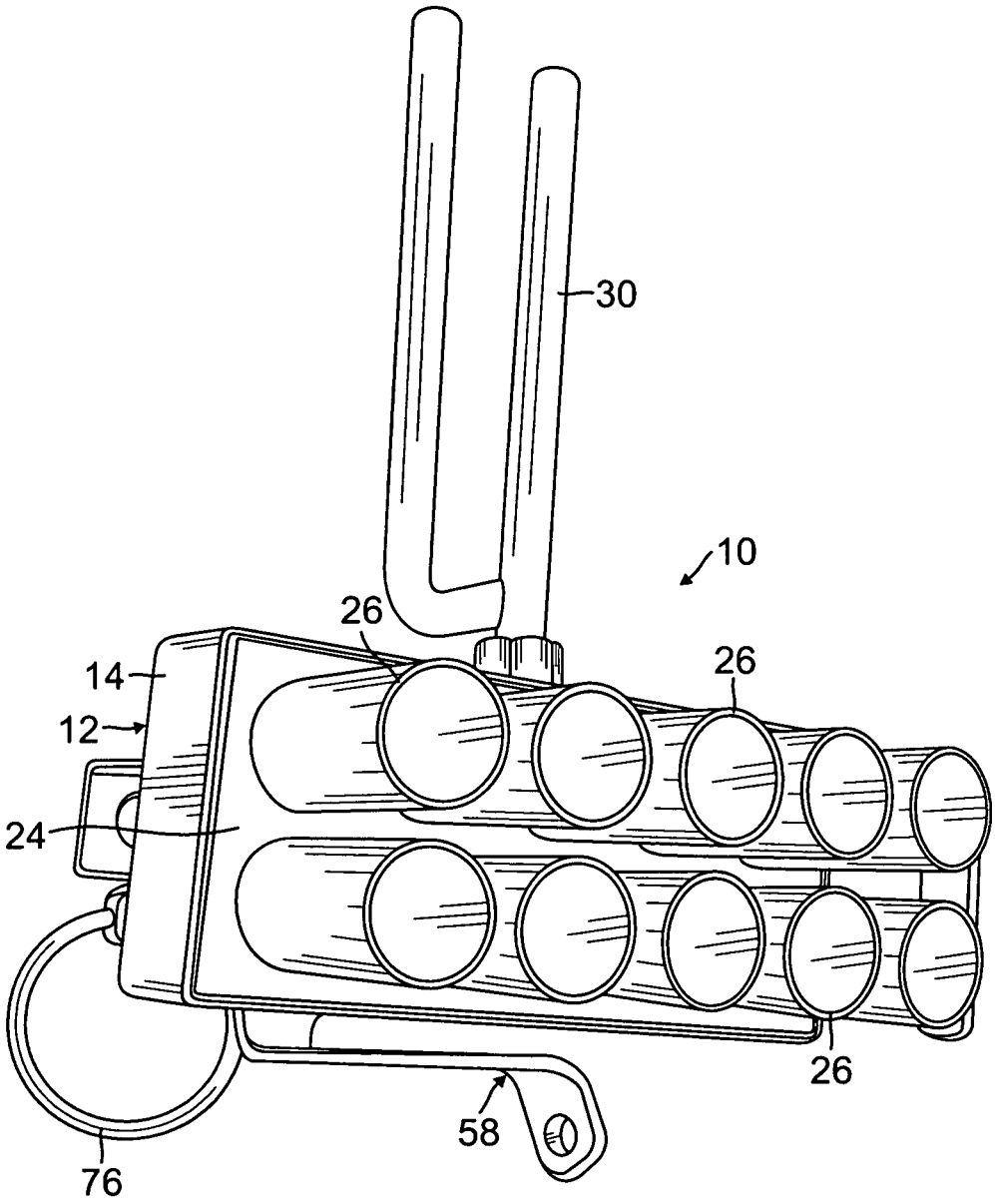
FIG. 2 is a top perspective view of the invention shown in FIG. 1.
Figure 3:
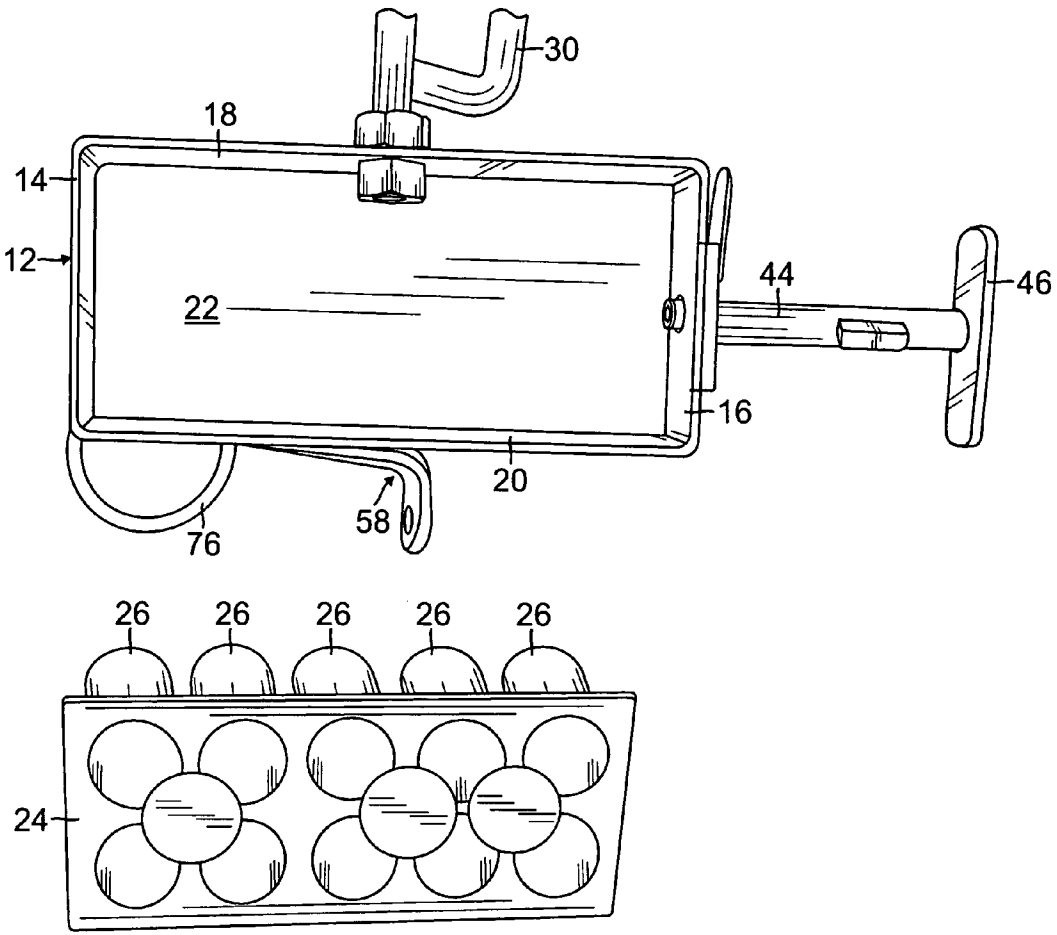
FIG. 3 is a partially exploded perspective view of the invention shown in FIG. 1.
Figure 4:
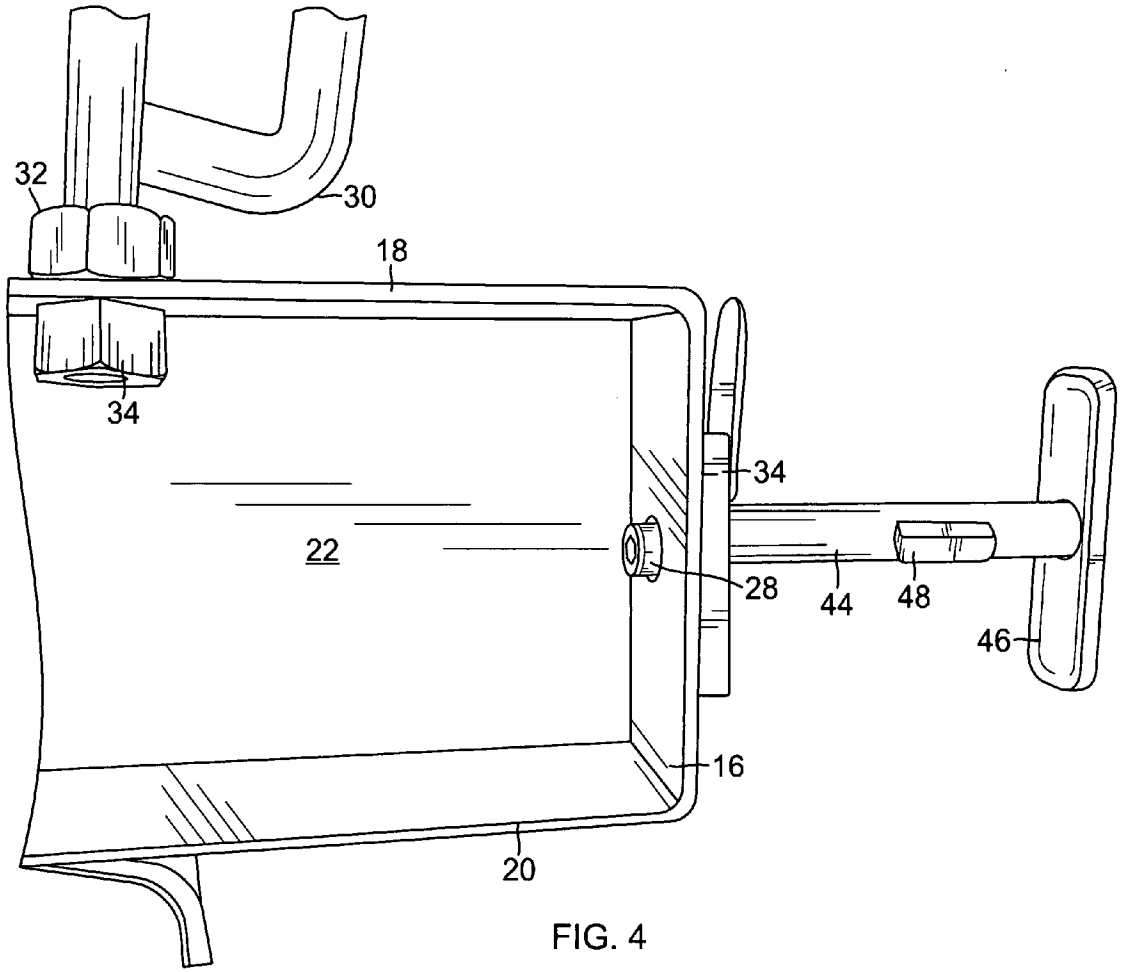
FIG. 4 is a detail view of a portion of an open top chamber used with the present invention.
Figure 5:
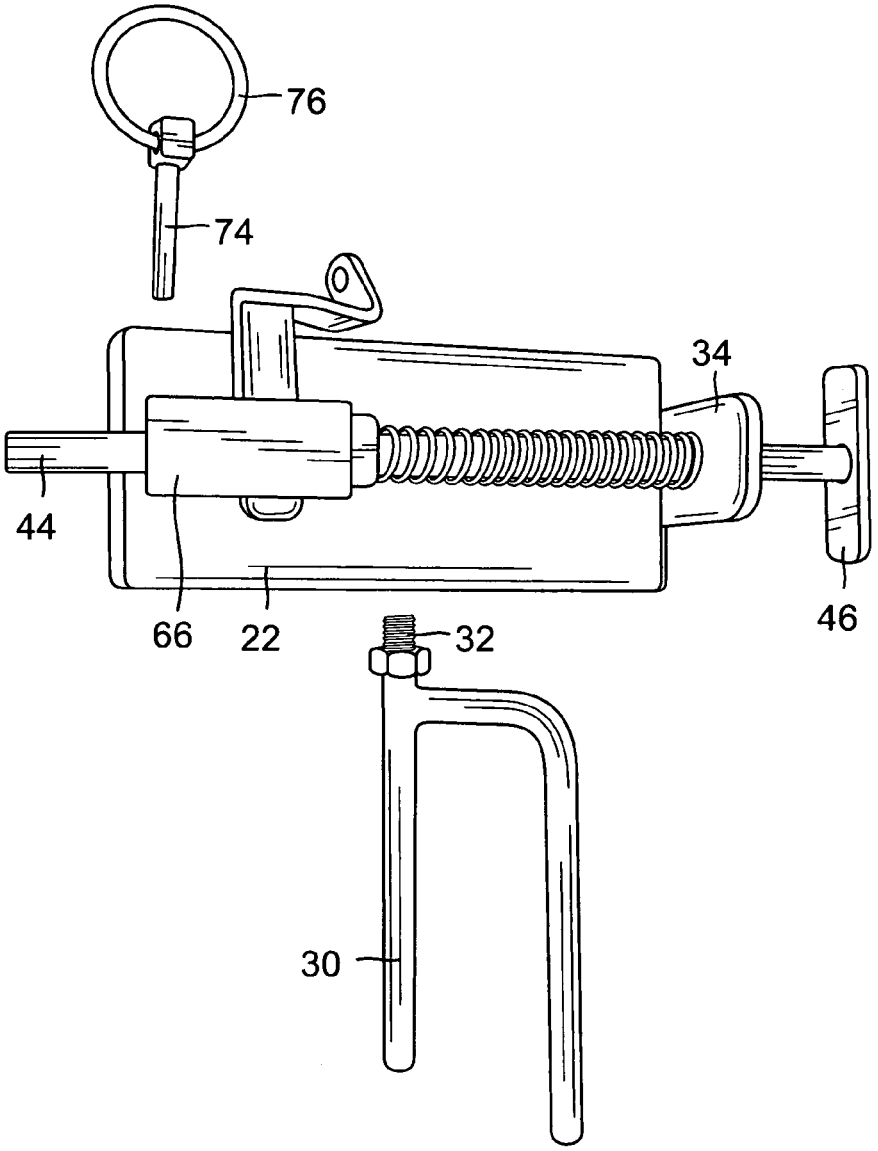
FIG. 5 is an exploded top view of the invention shown in FIG. 1.

A multi barrel paint ball mine apparatus 10 is shown in FIGS. 1 and 2. The apparatus 10 includes an open top chamber 12 having end walls 14 and 16, side walls 18 and 20 and a floor 22 as shown in FIG. 3. A lid 24 is sized to fit on top of the chamber 12 and is secured thereto as by welding as shown in FIG. 1. The lid 24 is provided with a plurality of barrels 26 which open into the chamber 12. The bottom of each of the barrels 26 has a stop (not shown) for retaining a paint ball in the barrel 26 prior to firing. The end wall 16 is provided with a primer receptor 28 as shown in FIG. 4. The primer receptor 28 is sized and shaped to receive a firearm cartridge primer which in a preferred embodiment is a 209 primer but many other primers would work equally as well such as primers used with shotguns. A stake 30 having a threaded bolt end 32 is threaded into a nut 34 located on the inside of wall 18 as shown in FIGS. 4 and 5. The stake 30 is used for either planting the apparatus 10 in the ground or also as a handle for manually holding the apparatus.

Figure 6:
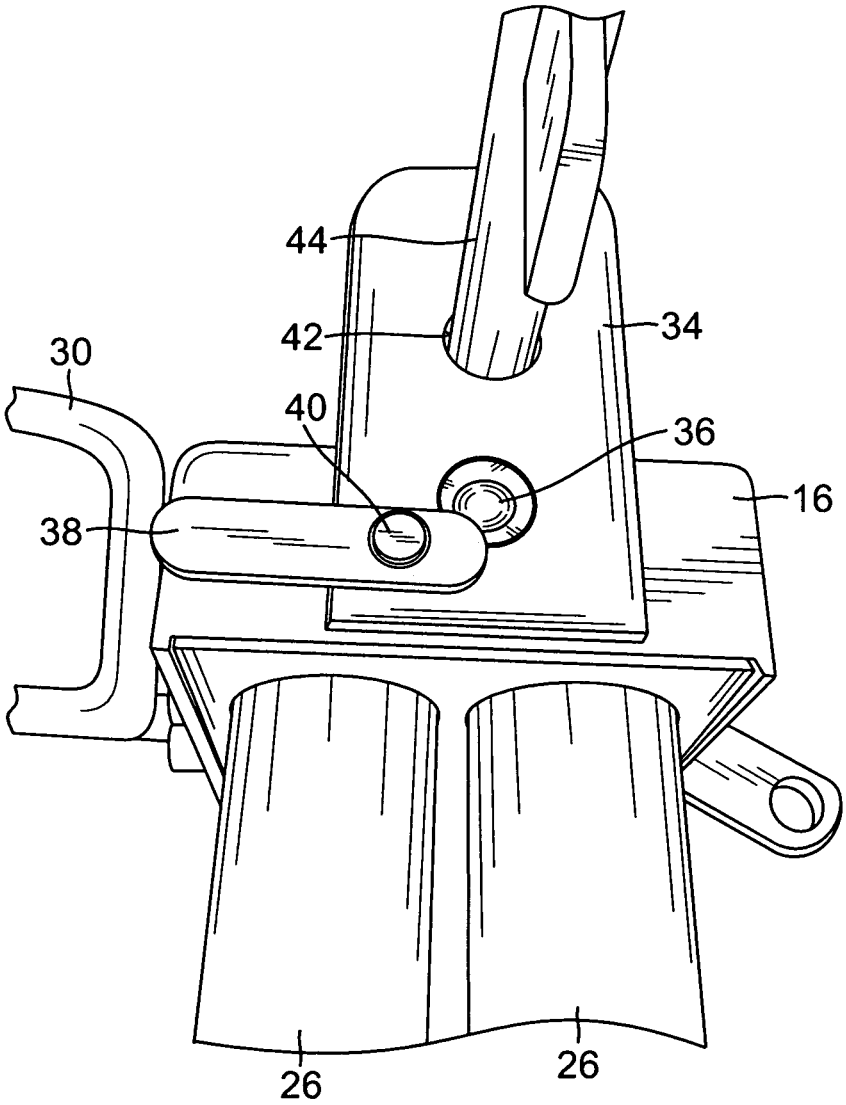
FIG. 6 is a detail right hand view of the invention shown in FIG. 1.
Figure 7:
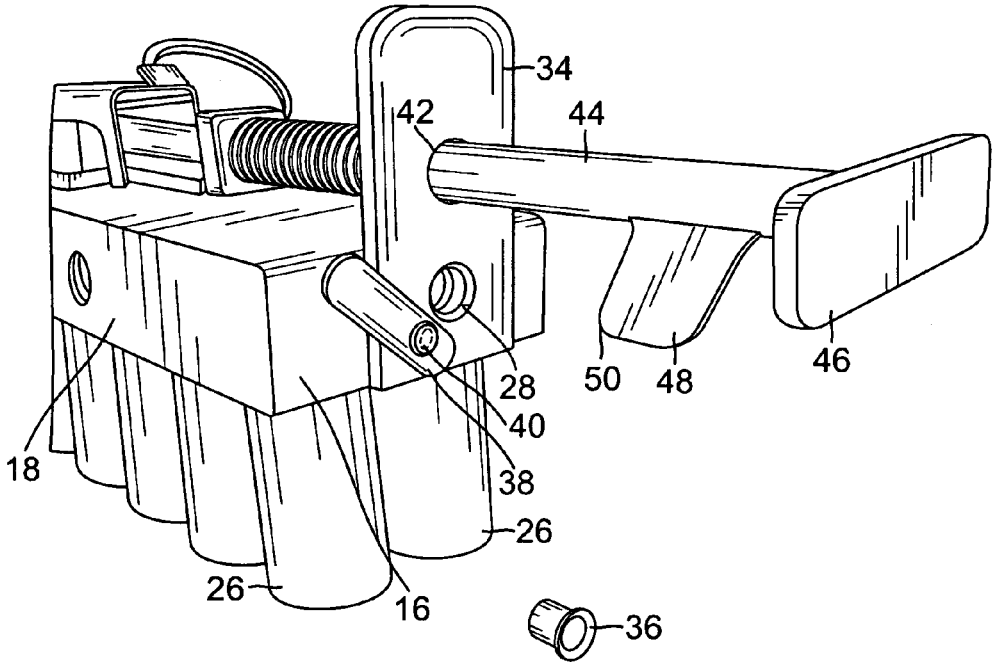
FIG. 7 is a detail perspective right hand view of the invention shown in FIG. 1.

A bracket 34 is secured to the wall 16 of the chamber 12 as by welding as shown in FIGS. 4 and 6. The primer receptacle 28 extends through bracket 34 to receive a primer 36. A primer retainer arm 38 is rotatably mounted on pin 40 and is sized so that the arm 38 may be rotated to partially cover the primer 36 when in place to prevent the primer from dropping out of the primer receptacle 28 as shown in FIG. 6. The bracket 38 may be rotated on the pin 40 so that the primer 36 can be removed from the primer receptacle 28 as shown in FIG. 7.

Figure 8:
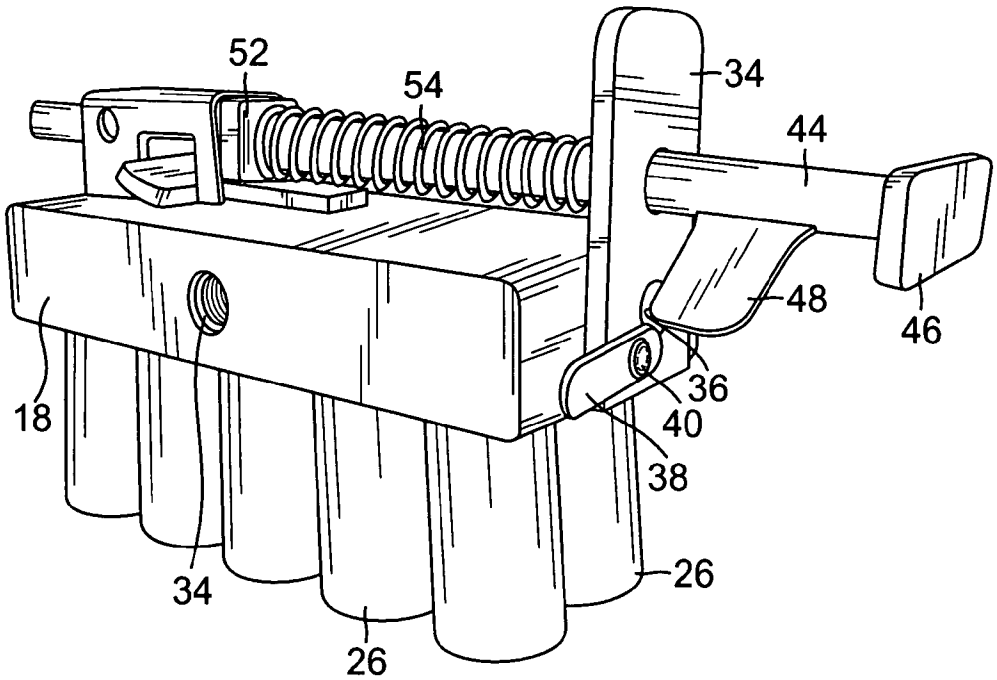
FIG. 8 is a left side perspective elevational view of the invention shown in FIG. 5 with parts broken away.
Figure 9:
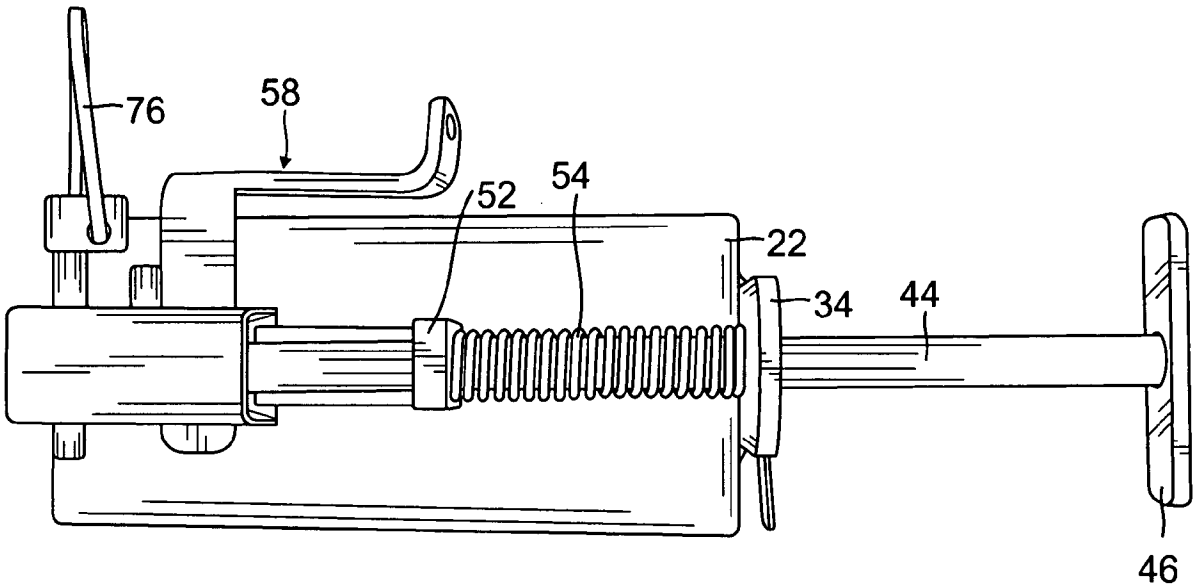
FIG. 9 is a bottom view of the invention shown in FIG. 1 with a cocking arm shown in a cocked position.

The bracket 34 has a hole 42 provided therein for slidably receiving a cocking rod 44. At one end of cocking rod 44 is provided a handle 46 for manipulating the cocking rod 44: A firing pin 48 is secured to the cocking rod 44 as by welding and has a tip 50 sized to strike the primer 36 located in the primer receptacle 28 as shown in FIG. 8. A block member 52 is mounted on the cocking rod 44 as shown in FIGS. 8 and 9. A coil tension spring 54 is mounted on the cocking rod 44 between the block member 52 and the bracket 34.

Figure 10:
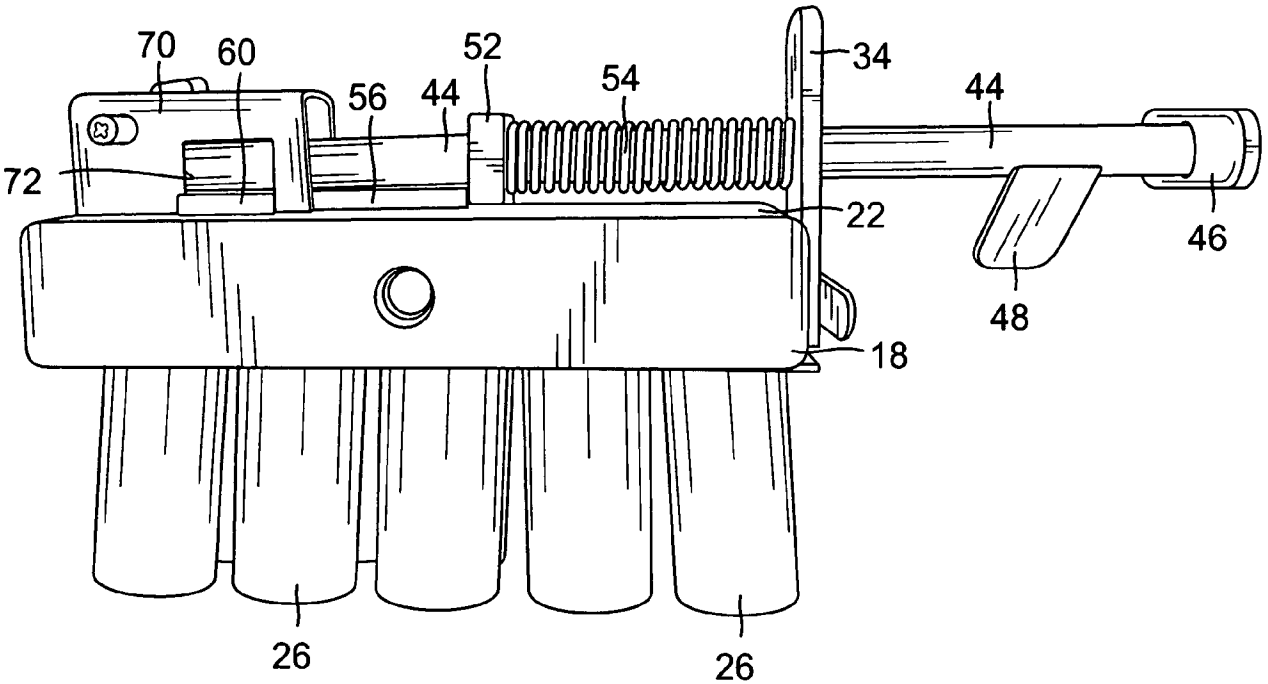
FIG. 10 is a front elevational view of the invention shown in FIG. 9.

A ledge member 56 is mounted on an outside surface of the floor 22 of the chamber 12 as shown in FIG. 10. When the rod 44 is drawn outwardly from the bracket 34 against the bias force of the spring 54 and the block 52 manipulated to rest against the ledge member 56, the apparatus 10 is in a cocked position as shown in FIG. 10.

Figure 11:
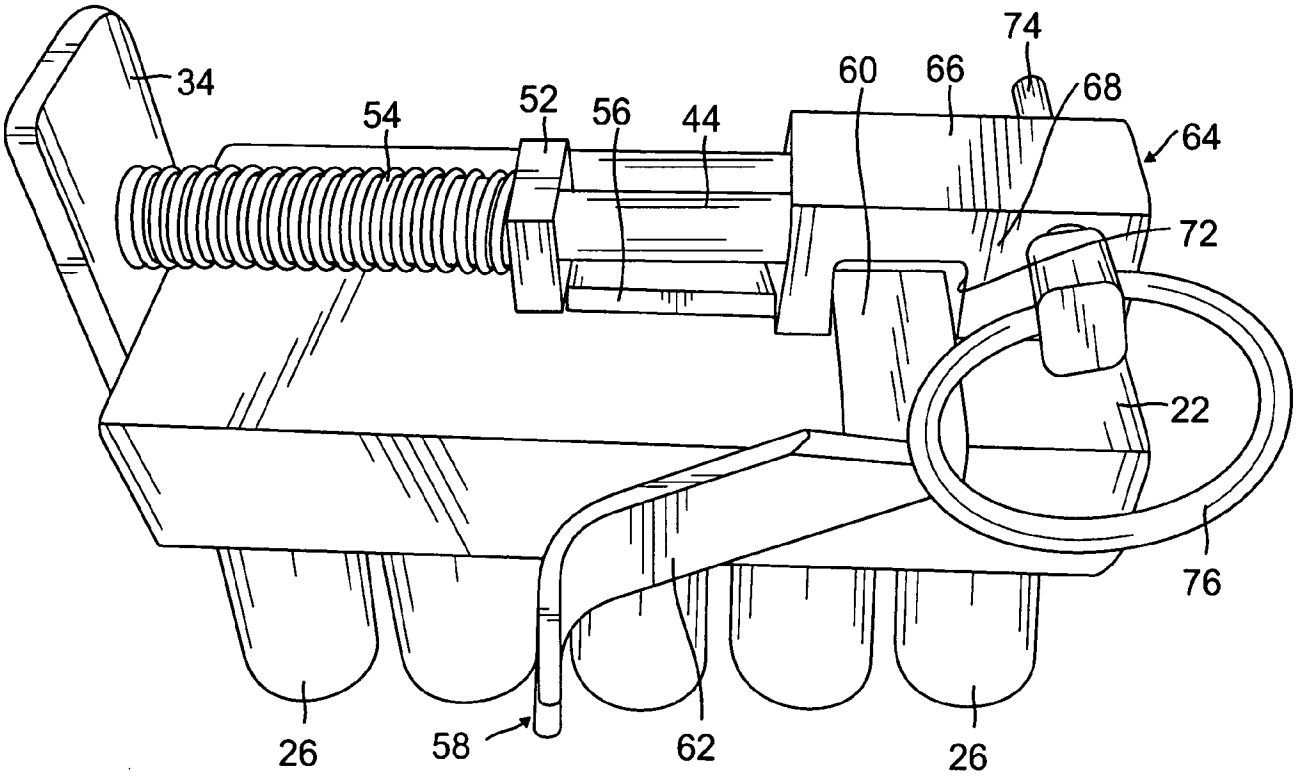
FIG. 11 is a detail view showing a safety pin used with the present invention.
Figure 12:
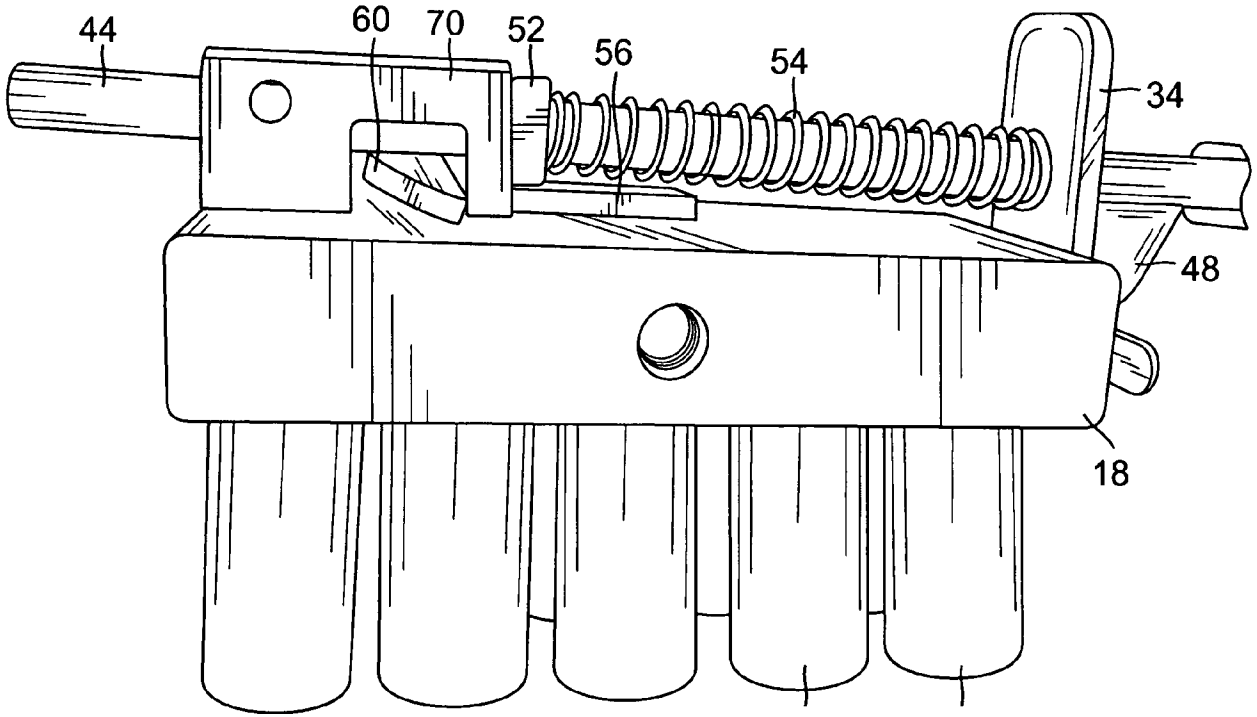
FIG. 12 is an elevational view of the present invention showing a trigger for releasing the cocking rod.

A trigger 58 is used to release the firing pin 48 when the firing pin 48 is in the cocked position as shown in FIGS. 10 and 11. The trigger 58 includes a trigger arm 60 and a trigger handle 62. The trigger arm 60 lies on the floor 22 underneath the cocking rod 44 as shown in FIGS. 10 and 11. In a preferred embodiment, a case 64 having a top 66 and two sidewalls 68 and 70 is welded to the floor 22. The sidewalls 68 and 70 are each provided with an enlarged opening 72 sized to allow the trigger arm 60 to tip upwardly against the cocking rod 44 thereby disengaging the block 52 from the ledge 56 as shown in FIG. 12. When this happens, the spring 54 causes the firing pin 48 to strike against the primer 36. The explosive force of the primer in the chamber 12 causes the pellet balls in the barrels 26 to be projected outwardly. The trigger handle 62 may be manipulated manually with the hand of a user or it could be manipulated by pulling a string attached to the handle 62 or by a trip wire attached to the handle 62. The trigger arm 60 is also provided with lugs (not shown) preventing the trigger arm 60 from slipping out of the enlarged openings 72.

Figure 13:
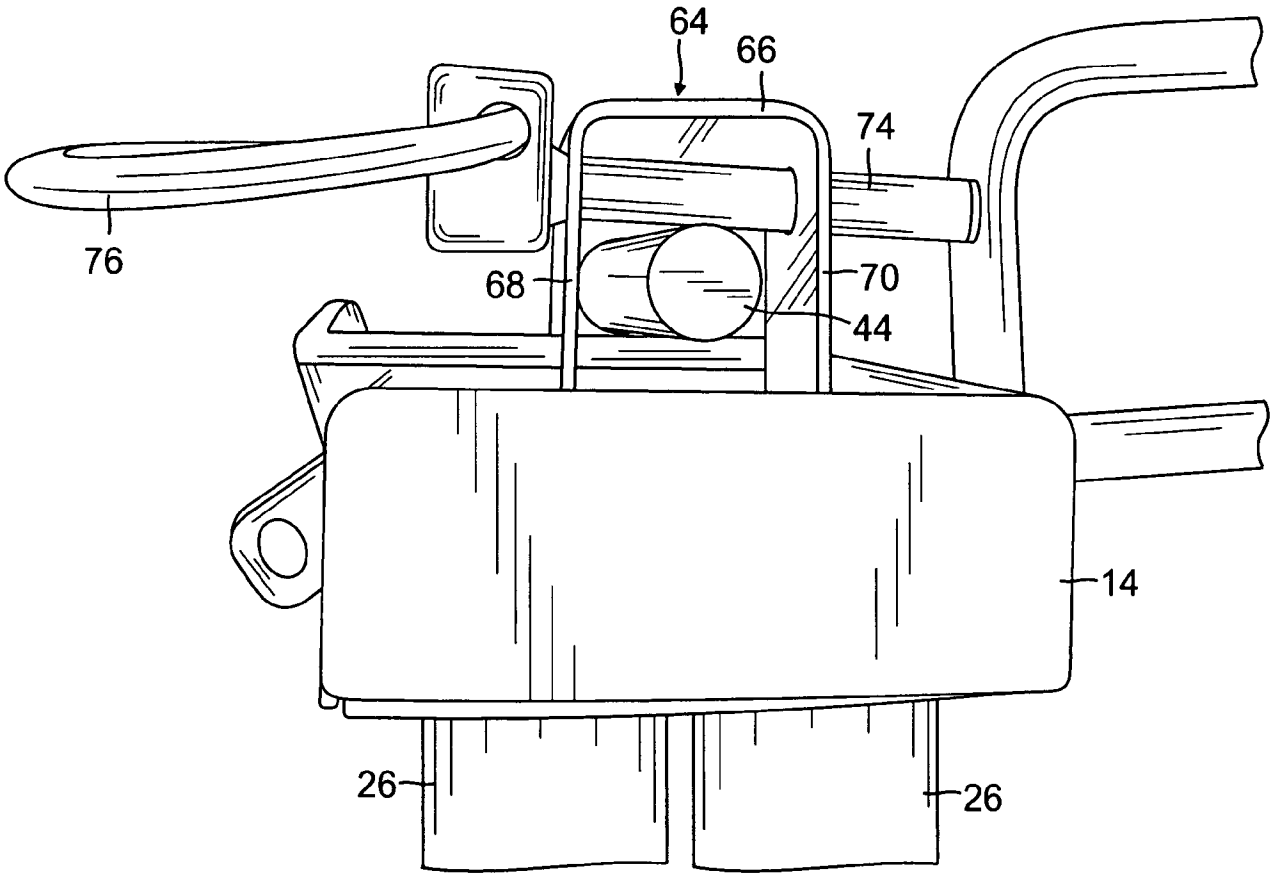
FIG. 13 is a detail end view of the present invention showing a safety pin.

A safety pin 74 is used to prevent accidental firing. The two sidewalls 68 and 70 of the case 64 are provided with aligned holes through which the safety pin 74 extends as shown in FIG. 13. The holes in the sidewalls 68 and 70 are positioned so that when the firing pin 48 is used, the firing pin extends across the top of the cocking rod 44 thereby preventing the block 52 from disengaging from the ledge member 56 when the apparatus 10 is in the cocked position.

In operation, the present invention is easy to user and set up. Paint balls are inserted in the barrels 26 and a primer 36 is inserted in the primer receptacle 28. The apparatus 10 is then manually held with the stake 30 or the stake 30 is driven into the ground. The cocking rod 44 is then drawn outwardly against the bias force of the spring 54 and the block member 52 is tipped to engage the block member 52 with the ledge member 56. When the trigger arm 60 is tipped by manipulating the trigger handle 62, the block member 52 is disengaged from the ledge member 56 and the firing pin 48 under the force of the spring 54 strikes the primer 36. When the primer 36 explodes there is a loud noise and the explosive force causes the pellet balls in the barrels 26 to be projected outwardly in a spread pattern providing a realistic experience of a land mine simulation. By mounting the barrels 26 at an angle to the lid 24, a variety of patterns can be achieved. The apparatus 10 is reusable by inserting new pellet balls in the barrels 26 and replacing the used primer 36.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims:

I claim:

1. A paint ball mine comprising:

an expansion chamber having a top wall, bottom wall, a pair of end walls and a pair of side walls;

a plurality of barrels mounted to the top wall of the expansion chamber, each barrel opening into the expansion chamber and adapted to receive a paint ball;

a firearm primer;

a primer receptacle opening through a first end wall of the expansion chamber adapted to receive the primer;

a bracket secured to the outer surface of the bottom wall adjacent the first end wall;

a cocking rod slidably mounted to the bracket;

a firing pin secured to the cocking rod and adapted to strike the primer held within the primer receptacle;

the cocking rod movable from a cocked position to a firing position where the firing pin strikes the primer;

means mounted to the cocking rod for resilient biasing the cocking rod toward the firing position;

the cocking rod movable against the bias force of the means for resilient biasing to the cocked position;

means for releasably holding the cocking rod in the cocked position;

means for triggering a release of the cocking rod from the cocked position whereby the cocking rod with firing pin are advanced to the firing position with the bias force of the resilient means.

2. The paint ball mine according the claim 1 further including a stake member attached to an exterior surface of a side wall.

3. The paint ball mine according to claim 2 wherein the stake member is rotatably attached to the exterior surface of the side wall.

4. The paint ball mine according to claim 1 further including a removable safety pin preventing the means for triggering a release from releasing the cocking rod in the cocked position.

5. A paint ball mine comprising:

an expansion chamber having a top wall, bottom wall, a pair of end walls and a pair of side walls;

a plurality of barrels mounted to the top wall of the expansion chamber, each barrel opening into the expansion chamber and adapted to receive a paint ball;

a firearm primer;

a primer receptacle opening through a first end wall of the expansion chamber adapted to receive the primer;

a bracket secured on the outer surface of the bottom wall adjacent the first end wall;

a cocking rod slidably mounted to the bracket;

a firing pin secured to the cocking rod and adapted to strike the primer held within the primer receptacle;

a block member secured to the cocking rod;

a tension spring mounted on the cocking rod and extending between the block member and the bracket;

a ledge member secured to the outer surface of the bottom wall;

the cocking rod movable from a cocked position to a firing position where the firing pin strikes the primer;

the cocking rod movable against the bias force of the spring to the cocked position;

the cocking rod further movable in the cocked position to a position where the block member releasably abuts an edge of the ledge member for releasably holding the cocking rod in the cocked position;

a trigger including a trigger arm lying on the outer surface of the bottom wall underneath the cocking rod and a trigger handle for manipulating the trigger arm;

the trigger arm movable from a position lying flat on the bottom wall to a position lifting the cocking rod to a position disengaging the block from the ledge member whereby the cocking rod with firing pin are advanced to the firing position with the bias force of the spring.

6. The paint ball mine according to claim 5 further including a stake member attached to an exterior surface of a side wall.

7. The paint ball mine according to claim 6 wherein the stake member is rotatably attached to the exterior surface of the side wall.

8. The paint ball mine according to claim 5 further including:

a case secured to the outer surface of the bottom wall having a top wall and two side walls;

the top wall positioned over the top of the cocking rod and the two side walls positioned on either side of the cocking rod;

the two side walls having axially aligned throughholes positioned above the cocking rod in the cocked position; and a safety pin adapted to extend through the two throughholes whereby the cocking rod is prevented from moving to a position disengaging the block from the ledge member.

* * * * *